US005372556A

United States Patent [19]

Ropp

[11] Patent Number: 5,372,556

[45] Date of Patent: Dec. 13, 1994

[54] PULL-UP AND DIP EXERCISE DEVICE

[76] Inventor: John D. Ropp, 1527 Emanuel Dr., Natchitoches, La. 71457

[21] Appl. No.: 81,549

[22] Filed: Jun. 23, 1993

[51] Int. Cl.[5] ..... A63B 23/12

[52] U.S. Cl. ..... 482/41; 482/97; 482/133; 482/137; 482/38

[58] Field of Search ..... 482/38–42, 482/26, 51, 70, 81, 97–103, 112–113, 133–137, 142, 148

[56] References Cited

U.S. PATENT DOCUMENTS

| | | | |
|---|---|---|---|
| 458,382 | 8/1891 | Zander . | |
| 3,116,062 | 12/1963 | Zinkin | 432/137 X |
| 3,558,130 | 1/1971 | Anderson . | |
| 3,874,657 | 4/1975 | Niebojenski | 482/38 X |
| 4,111,414 | 9/1978 | Roberts . | |
| 4,405,128 | 9/1983 | McLaughlin et al. | 482/97 |
| 4,621,810 | 11/1986 | Cummins | 482/97 X |
| 4,846,458 | 7/1989 | Potts . | |
| 4,923,195 | 5/1990 | Calderone | 482/97 |
| 4,951,939 | 8/1990 | Peters . | |
| 4,971,316 | 11/1990 | Daleboot et al. | 482/112 X |
| 5,011,139 | 4/1991 | Towley, III . | |
| 5,108,095 | 4/1992 | Nichols | 482/97 X |

FOREIGN PATENT DOCUMENTS

| | | | |
|---|---|---|---|
| 9218202 | 10/1992 | WIPO | 482/41 |

OTHER PUBLICATIONS

Brochure from Body Masters, BE222, Weight Assisted Chin & Dip Station.

Article published in *HI-TECH Coaching & Training*, May/Jun. 1993, under Health Clubs, entitled "Nautilus machine assists in workout."

*Primary Examiner*—Stephen R. Crow
*Assistant Examiner*—John Mulcahy
*Attorney, Agent, or Firm*—Baker & Botts

[57] ABSTRACT

An assisted pull-up and dip exercise device (10) which includes a frame (12), with both a pull-up bar (22) and dip bar (24), capable of supporting a person while performing these exercises. The invention includes an assist arm assembly (40) which connects to the frame (12) at the pivot point about which the assist arm assembly (40) rotates. The assist arm assembly (40) can be loaded at one end to provide variable counter-balancing support for the person while performing the exercise. Assisted pull-up and dip device (10) allows a person to perform the pull-up and dip exercises with the knees in a tucked position. This is the natural position for a person performing these exercises unassisted. The assist arm assembly (40) can be constructed so as to use common free weights to load the assist arm assembly (40). This removes the requirement for specialized weights which can only be used on a single exercise machine.

23 Claims, 2 Drawing Sheets

PULL-UP AND DIP EXERCISE DEVICE

TECHNICAL FIELD OF THE INVENTION

This invention relates in general to the field of exercise devices, and more particularly, to an improved assist-lift pull-up and dip exercise device.

BACKGROUND OF THE INVENTION

Pull-up and dip exercises provide excellent conditioning because each exercise develops several major muscle groups in the upper body. Conventional pull-up and dip exercise devices require a great deal of upper body strength because both exercises require the user to support and move the entire body against the effects of gravity. Often, the person exercising cannot perform multiple repetitions of these exercises. Even if multiple repetitions can be accomplished, the exerciser tires quickly and cannot usually maintain a high number of repetitions over multiple sets. Users of exercise equipment recognize that performing multiple repetitions over a number of sets produces more beneficial muscular development than performing a small number of repetitions over fewer sets. A device to assist the user to perform multiple repetitions of these exercises would provide a better exercise and increased health benefits to the user.

Prior pull-up and dip exercise devices have attempted to address the problem of assisting the user to perform a greater number of repetitions of these exercises. However, while these prior devices provide assistance, they tend to restrict the ability of the user to perform the exercise in a natural pull-up or dip position. These prior devices have also tended to be complicated, difficult to operate and expensive to manufacture.

Towley's device, U.S. Pat. No. 5,011,139 utilizes a foot bar mechanism for providing the user with assistance. Towley teaches a device with a frame, both pull-up and dip extension bars and a pivotal foot bar connected by a pulley system to a set of weights. To gain the assistance, the user stands on the foot bar while performing the desired exercise.

Potts, U.S. Pat. No. 4,846,458, discloses a frame similar to Towley, but the assisting portion of the Potts invention consists of a pneumatically powered, computer controlled platform upon which the user stands while exercising. A complicated computer control panel regulates the air compression motor which provides the air compression to the pneumatic ram which moves against a pivotal beam attached to the platform. This somewhat complex system used to provide the assisting force includes a power source, two separate relays, a compressor, an accumulator with a bleed valve, an electronic console, and a pneumatic ram having a safety valve and a flow control valve.

Roberts, U.S. Pat. No. 4,111,414, discloses a pull-up assisting device incorporating a single pulley and weight stack system attached to a harness for cancelling at least a portion of the weight of the user during the exercise. The Roberts device only teaches this method of assistance for pull-up exercises, not dips. Roberts teaches assisting the user by sitting in the harness when performing the exercise. The device incorporates an assistance system wherein the pulley cable transfers a counter-balancing force from the weight stack to a harness looped around the user's legs. The system is less manageable than the previously discussed devices because the user must first set the weight, then pull down the harness, and finally step into the harness while the cable remains in tension.

Therefore, a need has arisen in the industry for an improved device to assist the user to perform pull-up and dip exercises simply and in a more natural body position.

SUMMARY OF THE INVENTION

The present invention comprises an improved assisted pull-up and dip exercise device which can be used to perform multiple repetitions of these exercises. In accordance with the present invention, an exercise device for assisting the user during either pull-up or dip exercises is provided which substantially eliminates or reduces disadvantages and problems associated with prior assisted pull-up and dip exercise devices. The present invention provides an easy to use device which allows the user to perform each exercise in a position the body naturally tends toward when performing these exercises unassisted.

The present invention provides an exercise device to assist the user when doing either pull-ups or dips. The device assists the user by way of an assist arm assembly pivotally attached to the frame. A load is applied to the assist arm assembly at the end opposite the user. The opposite side of the assist arm comes in contact with the user's knees and effectively offsets a portion of the user's weight during the pull-up or dip exercises. The load (free weights) placed on the assist arm uses the force of gravity to assist moving the body upwardly during either a pull-up or dip exercise. The present invention allows a user to perform a greater number of repetitions over a greater number of sets.

One technical advantage of the present invention is the simplicity of its design. The assist arm assembly pivots at one point. This simple design eliminates the requirement of prior devices for more complicated pulley or computerized pneumatic control systems.

Another technical advantage of the present invention is the use of ordinary free weights when providing a counterbalancing force to the effect of gravity. The weights may be easily removed and used in other training exercises. This feature eliminates the need for an attached, single use set of weights which can only be used in one application and must either remain attached during movement of the device, or will necessitate disassembly prior to movement of the device. Also, the free weights may be easily added or removed to accommodate different users and different difficulty levels for a particular user.

Another technical advantage of the present invention is that it allows the user to maintain a natural body position while performing the exercise. During an unassisted pull-up or dip, the body naturally tends toward bending the knees in a tucked position, so that the lower portion of the legs are somewhat parallel with the ground. In the present invention, the assist arm contacts the user's knees and allows the legs to bend back in a tucked position to simulate the more natural position in which to perform pull-up or dip exercises.

An alternative embodiment of the present invention allows the user to perform pull-up and dip exercises with or without assistance as desired by the user.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

DETAILED DESCRIPTION OF THE INVENTION

Figure 1:
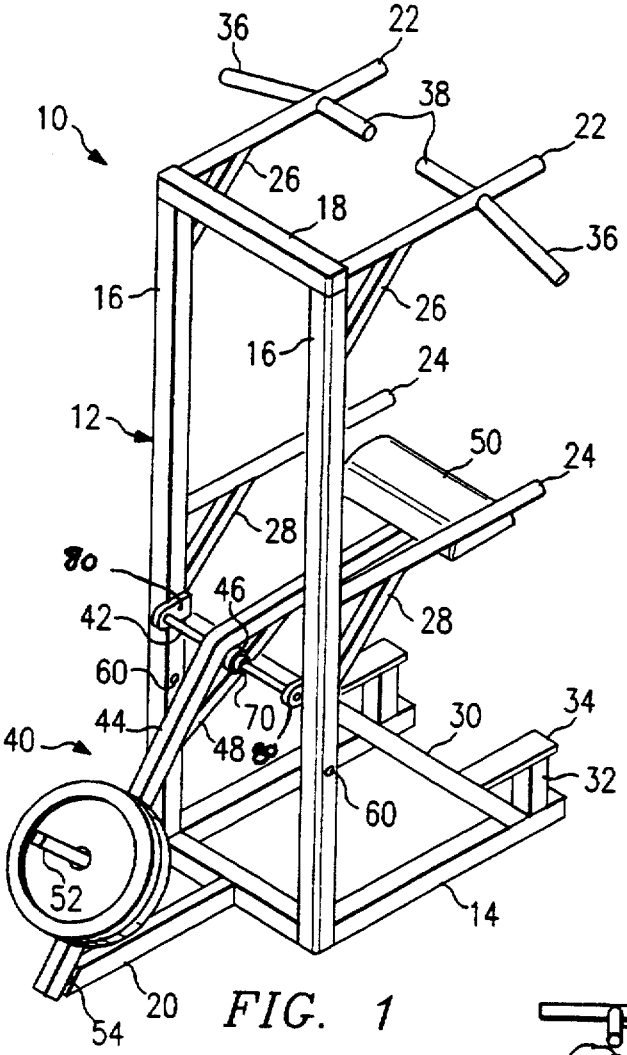
FIG. 1 is a perspective view of the assisted pull-up and dip device of the invention.

The preferred embodiments of the present invention are illustrated in FIGS. 1, 2*a*, 2*b*, 3*a*, 3*b* and 4 of the drawings, like numerals being used to refer to like and corresponding parts of the various drawings.

The assisted pull-up and dip device 10 includes a frame 12 comprising an approximately U-shaped base 14, two vertical bars 16, a top cross bar 18, and an extended base support bar 20. The base 14 is approximately U-shaped consisting of three bars, one of which is coupled at each of its ends to the ends of the two other bars to form the U-shape. Two vertical bars 16 are coupled, one each at the corner sections of the base, and extend upwardly from the two corners of the base 14 in an approximately parallel manner and couple to the top cross bar 18. Base support bar 20 is coupled to the base 14 approximately ½ the distance between the corners of the base 14, and extends in the same plane as the base but in the opposite direction of the base members. Two pull-up bars 22 extend horizontally, in generally the same direction as the base 14. One pull-up bar 22 extends from each intersection of the vertical bars 16 and the top cross bar 18. Two dip bars 24 extend horizontally, in generally the same direction as the pull-up bars 22. Each dip bar extends from one of the vertical bars 16, at approximately ½ the distance from the base 14 to the top cross bar 18.

Two top support braces 26 are coupled, one each, to both a pull-up bar 22 and a vertical bar 16. The top support brace 26 intersects the vertical bar 16 at approximately one foot beneath the intersection of the pull-up bar 22 and the vertical bar 16. The top support brace 26 intersects the pull-up bar 22 at approximately one foot outward from the intersection of the pull up bar 22 and the vertical bar 16. These top support braces provide support to the pull up bars 22 during the performing of a pull-up to reduce deformation of the pull-up bars 22.

Two middle support braces 28 are coupled, one each, to both a dip bar 24 and a vertical bar 16. The middle support brace 28 intersects the vertical bar 16 at approximately one foot beneath the intersection of the dip bar 24 and the vertical bar 16. The middle support brace 28 intersects the dip bar 24 at approximately one foot outward from the intersection of the dip bar 24 and the vertical bar 16. These middle support braces 28 provide support to the dip bars 24 during the performing of a dip exercise to reduce deformation of the dip bars 24.

Two bottom support braces 30 are coupled, one each, to both the base 14 and a vertical bar 16, at approximately ⅓ the distance upward from the intersection of the base 14 and the vertical bar 16 on the vertical bar 16, and at approximately 5/6 the distance outward from the intersection of the base 14 and the vertical bar 16 on a base bar extending in the same direction as the pull-up bars 22. The bottom support braces 30 provide support to the vertical bars 16 generally, and reduce deformation of the vertical bars 16 during the performance of any exercises.

Two foot pad support bars 32, are coupled to the base 14 near the end of its outwardly extending portion, between the end of the base 14 and the intersection of the bottom support brace 30 and the base 14. These foot pad support bars 32 extend vertically from the base 14 and provide support for the foot pads 34 when a person stands on the foot pads 34. The foot pads 34 extend horizontally, one each, from the bottom support braces 30 and are supported by the foot pad support bars 32. These foot pads allow a person to more easily access the knee pad when beginning an exercise.

Two outer pull-up handles 36 extend outwardly away from each other, one each from near the end of the pull-up bars 22 opposite the vertical bar 16. Two inner pull-up handles 38 extend inwardly towards each other, one each from near the end of the pull-up bars 22 opposite the vertical bar 16. The outer pull-up handles 36 and the inner pull-up handles 38 provide different grip positions in order to exercise the muscles in a slightly different manner. The outermost portions of the pull-up bars 22 may also be utilized as a third alternative grip position when performing pull-up exercises. An alternative embodiment includes adding grips to the inner pull-up handles, the outer pull-up handles, the outermost portions of the pull-up bars, and the outermost portions of the dip bar gripped by the user during the exercises.

The assistance to the user during a pull-up or dip exercise is provided by an assist arm assembly 40, having both a first end and a second end, which rotates about a middle cross bar 42. The middle cross bar 42 is coupled securely at each end to the vertical bars 16 at a height less than the height of the dip bars 24. The preferred embodiment includes an attaching plate 80 coupled to the vertical bar 16, to which the middle cross bar 42 couples. An alternative embodiment includes coupling the middle cross-bar 42 directly to the vertical bars 16 without the attaching plate 80.

A pivot assembly 46 is coupled to an articulated assist arm 44 which enhances the rotation of the articulated assist arm 44 about the middle cross bar 42. The pivot assembly 46 will preferably comprise a pair of bushings (not shown) contained within the pivot assembly 46 to enhance rotation. Shaft collars 70 are used to position pivot assembly 46 on middle cross bar 42 and to reduce movement longitudinally along the middle cross bar 42. The preferred embodiment of the pivot assembly 46 includes two oil impregnated brass bushings (not shown), spaced apart and contained within the tubular pivot assembly 46. Alternative embodiments of the pivot assembly 46 include other bushing arrangements, bushings made of different materials, and bearing systems to enhance rotation. An assist arm support brace 48 is coupled to the articulated assist arm 44 on either side of the pivot point to provide support to the articulated assist arm 44 and reduce deformation of the articulated assist arm 44 over time. An alternate embodiment includes a straight assist arm 44 without the assist arm support brace 48.

The assist arm assembly 40 further includes a knee pad 50 coupled to the user end of the articulated assist arm 44 to provide a contact point with the user. The preferred embodiment of the knee pad 50 includes a padded contact surface to enhance the comfort level to the user. The preferred embodiment also describes a pad which contacts the knee upon using the device. This feature of the present invention allows the user's legs to bend into a tucked position which is a more natural body position when performing either a dip or a pull-up exercise. An alternative embodiment would include an unpadded contact surface.

The contact point has been described as being at the knee. It should be understood, however, that the contact point can be anywhere from the knee to the top of the foot, defined herein as the knee-shin area.

The assist arm assembly 40 further includes a weight peg 52 coupled near the end of the articulated assist arm 44 opposite the knee pad 50. The counter-balancing weight is placed on the weight peg 52 to offset a portion of the user's body weight when performing the pull-up or dip exercises. In the preferred embodiment, the weight peg 52 extends outwardly, forming approximately a ninety degree angle with the articulated assist arm 44 at their intersection point. Alternative embodiments includes any method of providing a counter-balancing load to the assist arm 44, including positioning a similar weight peg on the side of the articulated assist arm 44, a pouch type carrier on the end of the articulated assist arm 44, or a separate pulley system. The preferred embodiment uses the weight peg 52 due to its ease and its usefulness because it allows the use of common free weights with the device 10.

The assist arm assembly 40 further includes an elastomer bumper 54 coupled near the end of the articulated assist arm 44 on the side opposite the weight peg 52. The bumper 54 is positioned so as to contact the extended base support bar 20 when the articulated assist arm 44 is extended at its rest position. This positioning of the articulated assist arm 44 leaves the knee pad 50 at approximately the height of the user's knees when the user stands on the foot pads 34. At this height, the knee pad 50 is more easily accessible to the user. Upon completion of an exercise, the user repositions the articulated assist arm 44 at its rest position by simply dismounting. The bumper 54 ameliorates the force at impact of the assist arm 44 and the base support bar 20.

Figure 4:
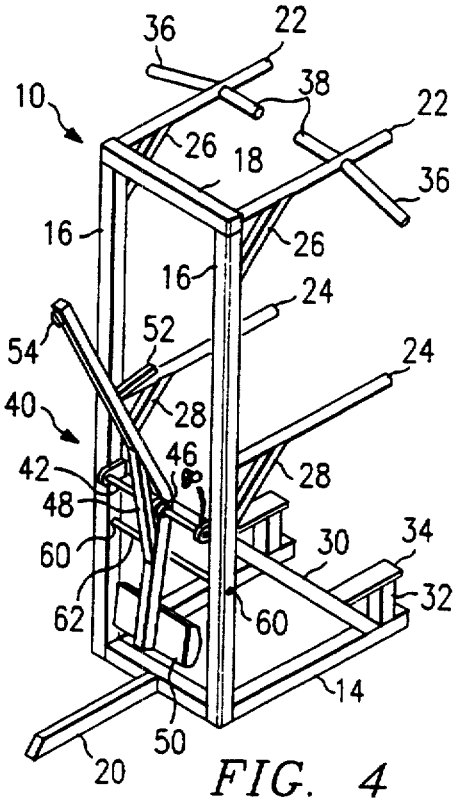
FIG. 4 is a perspective view of the assisted pull-up and dip device of FIG. 1 showing as alternative embodiment of the invention with the assist arm positioned out of the user's way to allow performing unassisted pull-up or dip exercises.
Figure 2A:
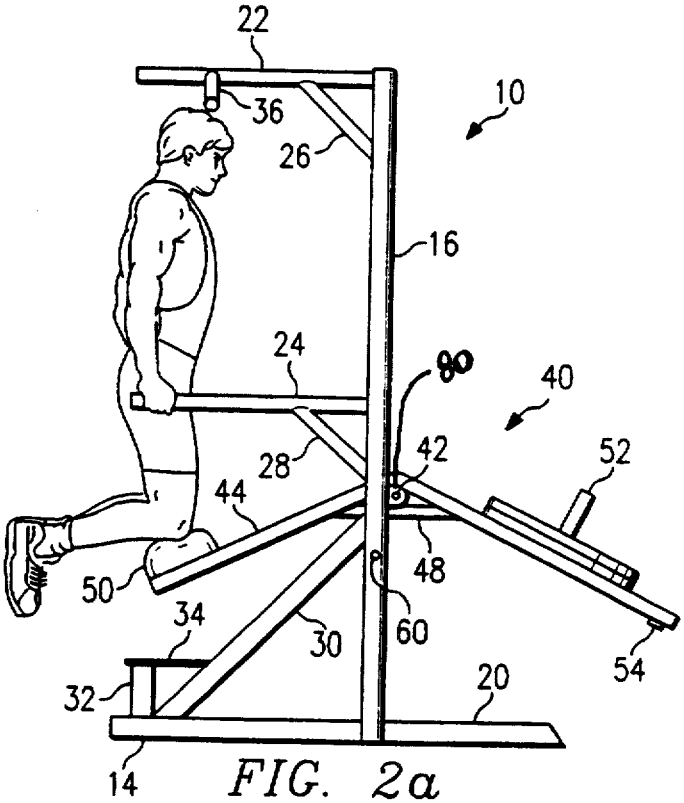
FIG. 2*a* is a side view of the assisted pull-up and dip device of FIG. 1 showing a person after initially mounting the device in preparation for a dip exercise (This position also represents the starting and finishing point of a dip exercise.)
Figure 2B:
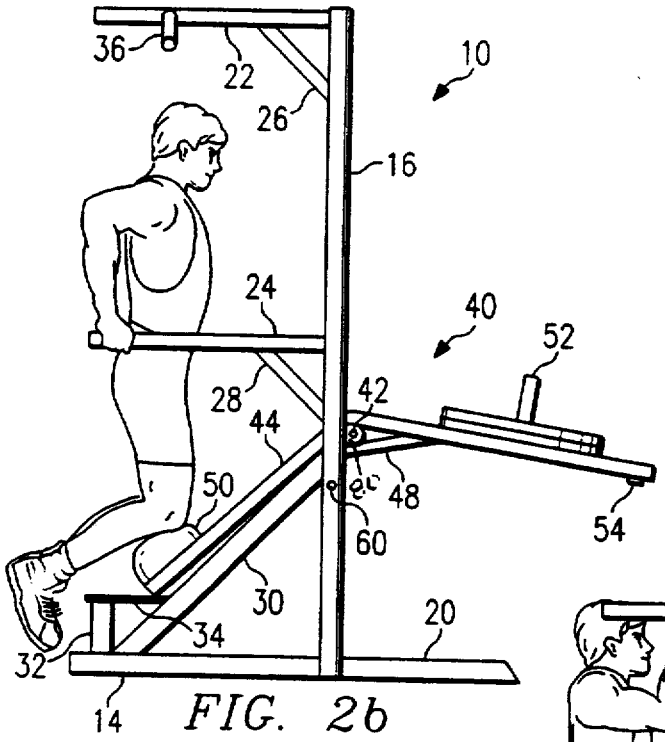
FIG. 2*b* is a side view of the assisted pull-up and dip device of FIG. 1 showing a person at the least elevated point of a dip exercise (This position also represents the mid-point of a dip exercise.)
Figure 3B:
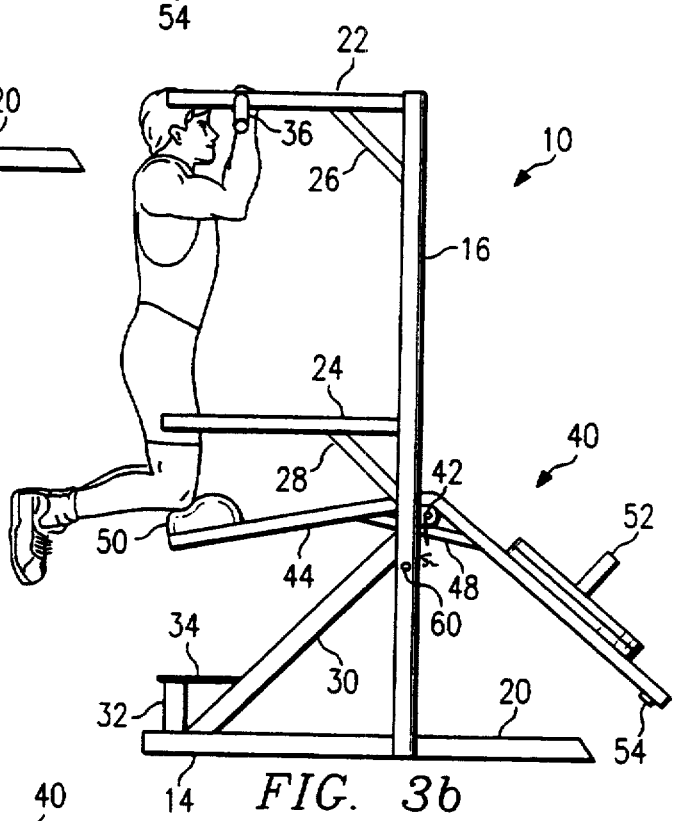
FIG. 3*b* is a side view of the assisted pull-up and dip device of FIG. 1 showing a person at the most elevated point of a pull-up exercise (This position represents the mid-point of a pull-up exercise.)
Figure 3A:
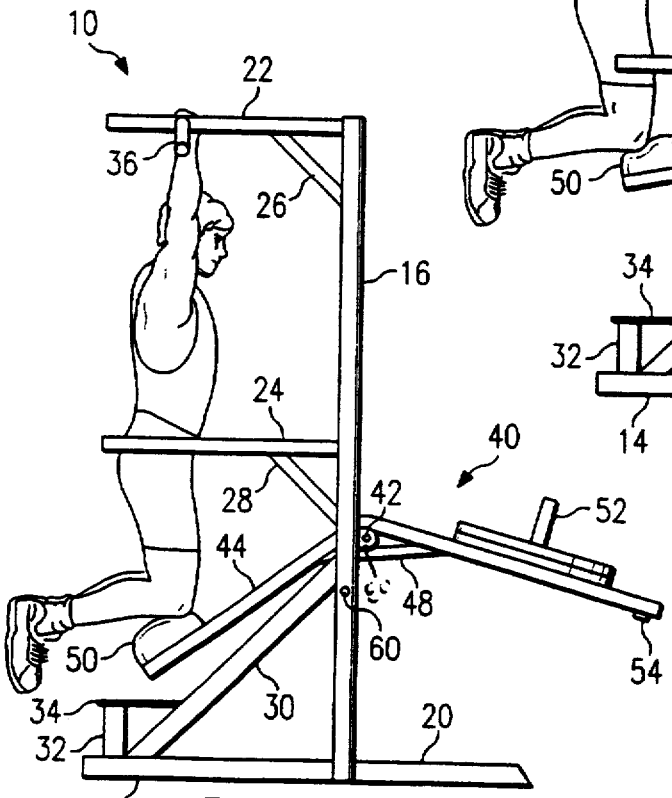
FIG. 3*a* is a side view of the assisted pull-up and dip device of FIG. 1 showing a person after initially mounting the device in preparation for a pull-up exercise (This position also represents the starting and finishing point of a pull-up exercise.)

The vertical bars 16 each include a hole 60 formed longitudinally through the vertical bars 16 at a position beneath the middle cross bar 42. These holes 60 allow a bottom cross bar 62 to couple to both the vertical bars 16 proximate to the holes 60 As shown in FIG. 4, this bottom cross-bar 62 allows the user to position the assist arm assembly 40 out of the user's path of motion when performing an unassigned pull-up or dip exercise. As an alternative, weight pegs (not shown) could be attached to holes 60 to store extra free weights.

In order to operate the present invention, the user must first decide which exercise will be performed. The user may load the articulated assist arm 44 by placing the desired amount of free weights on the weight peg 52. The user will then stand on the foot pads 34 prior to performing either a dip or pull-up exercise. A tall user may be able to eliminate this step and go to the next step.

To perform a dip exercise, the user will grasp the dip bars 24 near their ends with the palms facing down. The user will place both knees on the knee pad 50. The user then, with the aid of the assist arm assembly 40, performs a standard dip exercise whereby the user raises and lowers the body by bending at the elbows when lowering and pressing upwardly until the arms are fully extended when raising.

To perform a pull-up exercise, the user will grasp either the inner 38 or outer 36 pull-up handles. The user will place both knees on the knee pad 50. The user then, with the aid of the assist arm assembly 40, performs a standard pull-up exercise whereby the user raises and lowers the body by pulling upward when raising and allowing the body to return to the original position when lowering.

The present invention positions the assist arm assembly 40 under the user's knees to allow the user to tuck the legs back when performing the assisted pull-up or dip exercises. This position is a more natural one for the body during the performance of these assisted exercises. An unassisted pull-up or dip exercise will most often be performed with the legs tucked in a similar fashion. The present invention mirrors the unassisted body position. The present invention also provides a more simple pull-up and dip exercising device which uses ordinary free weights rather than a more complex weight counter-balancing system. The present invention provides an exercise device which may be used for either assisted or unassisted pull-up and dip exercises.

Although the present invention has been described in detail, is should be understood that various changes, substitutions, and alterations can be made hereto without departing from the spirit and scope of the invention as defined by the appended claims.

What is claimed is:

1. An assisted pull-up and dip exercise device comprising:

a frame;

a pull-up bar coupled to and extending from the frame to allow pull-up exercises to be performed;

a dip bar coupled to and extending from the frame to allow dip exercises to be performed;

an assist arm assembly consisting essentially of:

an angled assist arm pivotally coupled to the frame the assist arm having a first end and a second end with the pivot point disposed therebetween;

means positioned on the first end of the angled assist arm below the pull-up and dip bars for contacting the exerciser at approximately the knee-shin area, the respective spacing between the first end of the angled assist arm and the pull-up bar and the first end of the angled assist arm and the dip bar being selected to allow the exerciser's knee-shin area to contact the first end of the angled assist arm during performance of pull-up and dip exercises; and means for adding a weight to the second end of the angled assist arm for providing assistance in the performance of pull-up and dip exercises.

2. The assisted pull-up and dip exercise device of claim 1, wherein the frame further comprises:

a base;

a plurality of substantially vertical bars coupled to the base, each of said bars including an upper portion;

a top cross bar coupled to the vertical bars adjacent the upper portion of each vertical bar; and a support bar coupled to the base extending from the base to provide stabilization to the frame.

3. The assisted pull-up and dip exercise device of claim 2, wherein the frame further comprises:

a brace coupled between each vertical bar and each dip bar;

a brace coupled between each vertical bar and each pull-up bar; and a brace coupled between each vertical bar and the base.

4. The assisted pull-up and dip exercise device of claim 2, wherein the support bar extends from the base and contacts the portion of the assist arm assembly extending from the frame opposite the point of contact with the exerciser, to act as a stop for pivoting movement of the assist arm assembly.

5. The assisted pull-up and dip exercise device of claim 2, further comprising:

each vertical bar having a hole extending through the respective vertical bar intermediate the dip bar and the base; and an intermediate cross bar coupled to the vertical bars proximate to said holes for use in moving the assist arm assembly to a position which allows unassisted pull-up and dip exercises.

6. The assisted pull-up and dip exercise device of claim 1, wherein the frame further comprises:

a base having a plurality of vertical bars coupled thereto and extending upwardly therefrom; and a cross bar coupled between the vertical bars about which the assist arm assembly pivots.

7. The assisted pull-up and dip exercise device of claim 1, further comprising an elevated foot pad coupled to the frame.

8. The assisted pull-up and dip exercise device of claim 7, further comprising elevated foot pads coupled to the frame.

9. The assisted pull-up and dip exercise device of claim 1, wherein the dip bar includes a grip.

10. The assisted pull-up and dip exercise device of claim 1 further comprising a pair of inner handles coupled to the pull-up bar, extending inwardly towards the vertical centerline of the device.

11. The assisted pull-up and dip exercise device of claim 10, wherein each inner handle includes a grip.

12. The assisted pull-up and dip exercise device of claim 1, further comprising outer handles coupled to the pull-up bar, extending outwardly from the pull-up bar.

13. The assisted pull-up and dip exercise device of claim 12, wherein each outer handle includes a grip.

14. The assisted pull-up and dip exercise device of claim 1, wherein tile assist arm assembly further comprises:

the angled assist arm having an angled portion pivotally coupled to the frame by a cross bar, the cross bar being coupled between a pair of vertical bars extending from a base;

a pad coupled to the first end of the angled assist arm extending in generally the same direction as the dip and pull-up bars; and a weight peg extending upwardly from the second end of the angled assist arm on the portion of the angled assist arm extending generally opposite from the dip and pull-up bars for placement of a variable load thereon.

15. The assisted pull-up and dip exercise device of claim 14, further comprising a bumper coupled to the underside of the angled assist arm near the second end of the angled assist arm extending generally opposite from the dip and pull-up bars.

16. The assisted pull-up and dip exercise device of claim 15, wherein the bumper is formed from an elastomer.

17. The assisted pull-up and dip exercise device of claim 14, wherein the angled assist arm is pivotally coupled with a pivot assembly comprising:

the cross bar having a circular cross section;

a bushing contacting the circular cross bar;

a casing enveloping tile bushing; and a securing fastener coupled to tile circular cross bar approximately adjacent to the bushing.

18. The assisted pull-up and dip exercise device of claim 17, wherein the securing fastener comprises a shaft collar coupled to the circular cross bar.

19. The assisted pull-up and dip exercise device of claim 17, wherein the bushing further comprises a plurality of oil impregnated brass bushings spaced apart within the enveloping casing.

20. The assisted pull-up and dip exercise device of claim 14, wherein the weight peg further comprises a cross sectional area to accommodate the diameter of a standard free weight center hole, whereby the weight peg may be loaded with common free weights.

21. The assisted pull-up and dip exercise device of claim 14, wherein the cross bar couples at each end to an attaching plate which further are further coupled, one each, to the vertical bars.

22. The assisted pull-up and dip exercise device of claim 14, wherein the angled assist arm includes an angled portion disposed over the cross bar and the assist arm assembly further comprises a brace coupled to the angled assist arm on either side of the cross bar.

23. An assisted pull-up and dip exercise device comprising:

a frame including a base;

a plurality of substantially vertical bars coupled to the base, each of said bars including an upper portion;

a top cross bar coupled to the vertical bars adjacent the upper portion of each vertical bar;

a support bar coupled to the base extending from the base to provide stabilization to the frame;

a pull-up bar coupled to and extending from the frame to allow pull-up exercises to be performed;

a pair of dip bars coupled to and extending from the frame to allow dip exercises to be performed;

an intermediate cross bar coupled to the frame between the top cross bar and the base;

an assist arm assembly consisting essentially of:

an assist arm having a first end and a second end with the assist arm pivotally coupled to the intermediate cross bar by a pivot assembly between the first end and the second end of the assist arm at an angled portion of the assist arm, the intermediate cross bar being coupled between the vertical bars, the respective spacing between the first end of the assist arm and the dip bars being selected to allow the exerciser's knee-shin area to contact the assist arm during performance of respective pull-up and dip exercises;

a pad coupled to the assist arm and positioned near the first end of the assist arm extending in generally the same direction as the dip and pull-up bars; and a weight peg extending upwardly from the assist arm near the second end of the assist arm for adding weight to provide assistance in performance of pull-up and dip exercises.

* * * * *

UNITED STATES PATENT AND TRADEMARK OFFICE

CERTIFICATE OF CORRECTION

PATENT NO. : 5,372,556

DATED : December 13, 1994

INVENTOR(S) : John D. Ropp

It is certified that error appears in the above-identified patent and that said Letters Patent is hereby corrected as shown below:

On title page, [56] "Other Publications" add -- Body Masters Price List dated August 15, 1992 which makes reference to BE222.--

Column 3, line 49, after "as the base" insert -- 14 --,
Column 3, line 66, after "braces" insert -- 26 --, Column 7, line 60 after "wherein" delete "tile" and insert -- the --.

Column 8, line 19, after "enveloping" delete "tile" and insert -- the --.

Column 8, line 20, after "coupled to", delete "tile" and insert -- the --.

Signed and Sealed this

Sixteenth Day of May, 1995

Bruce Lehman

*Attest:*

BRUCE LEHMAN

*Attesting Officer*

*Commissioner of Patents and Trademarks*